US011325619B2

(12) United States Patent
Suarez Ajo

(10) Patent No.: US 11,325,619 B2
(45) Date of Patent: May 10, 2022

(54) UNIVERSAL PUBLIC TRANSPORT AND UTILITIES DISTRIBUTION SYSTEM

(71) Applicant: David Williams Suarez Ajo, Bogota DC (CO)

(72) Inventor: David Williams Suarez Ajo, Bogota DC (CO)

( * ) Notice: Subject to any disclaimer, the term of this patent is extended or adjusted under 35 U.S.C. 154(b) by 246 days.

(21) Appl. No.: 16/347,973

(22) PCT Filed: Nov. 3, 2017

(86) PCT No.: PCT/CO2017/000009
§ 371 (c)(1),
(2) Date: May 7, 2019

(87) PCT Pub. No.: WO2018/086636
PCT Pub. Date: May 17, 2018

(65) Prior Publication Data

US 2019/0256110 A1 Aug. 22, 2019

(30) Foreign Application Priority Data

Nov. 10, 2016 (CO) ..... NC2016/0003999

(51) Int. Cl.
*B61B 1/02* (2006.01)
*B61B 3/00* (2006.01)
(Continued)

(52) U.S. Cl.
CPC ..... *B61B 1/02* (2013.01); *B61B 1/00* (2013.01); *B61B 3/00* (2013.01); *E01C 1/00* (2013.01);
(Continued)

(58) Field of Classification Search
CPC .... B61B 1/00; B61B 1/02; B61B 3/00; E01C 1/00; E01C 1/04; E01D 11/00; E04H 14/00
See application file for complete search history.

(56) References Cited

U.S. PATENT DOCUMENTS 4,690,064 A * 9/1987 Owen ..... B61B 1/02 104/119
4,791,871 A * 12/1988 Mowll ..... B61B 15/00 104/94
(Continued)

FOREIGN PATENT DOCUMENTS

CN 102359044 A 2/2012
CN 205474786 U 8/2016
(Continued)

OTHER PUBLICATIONS

ISR; INAPI, AV; Chile; Jan. 12, 2018.

*Primary Examiner* — Jason C Smith
(74) *Attorney, Agent, or Firm* — Patshegen IP LLC; Moshe Pinchas

(57) ABSTRACT

The invention relates to a suspension bridge type self-supporting aerial metal structure, in which the main platform is designed having three levels. The upper level is intended for the passage of motor vehicles. The intermediate level is intended for the transportation, transmission and distribution of all existing public services, and other possible services. The lower level is intended for an urban public transport system. Thanks to its self-supported aerial design, the structure of the present invention can be built within cities following the same layout as existing roads.

6 Claims, 15 Drawing Sheets

(51) Int. Cl.

| | |
|---|---|
| ***E01C 1/04*** | (2006.01) |
| ***E01C 1/00*** | (2006.01) |
| ***B61B 1/00*** | (2006.01) |
| ***E04H 14/00*** | (2006.01) |
| ***E01D 11/00*** | (2006.01) |

(52) U.S. Cl.
CPC ..... *E01C 1/04* (2013.01); *E01D 11/00* (2013.01); *E04H 14/00* (2013.01)

(56) References Cited

U.S. PATENT DOCUMENTS

| | | | | |
|---|---|---|---|---|
| 5,456,183 | A * | 10/1995 | Geldbaugh | B61B 13/04 104/121 |
| 6,321,657 | B1 * | 11/2001 | Owen | B61B 1/02 104/119 |
| 8,113,125 | B2 * | 2/2012 | Hepner | B61B 13/04 105/141 |
| 9,096,236 | B2 * | 8/2015 | Kissel, Jr. | B61B 5/02 |
| 11,014,692 | B2 * | 5/2021 | Swan | B61B 13/08 |
| 2006/0196385 | A1 * | 9/2006 | Stromberg | B61B 3/02 104/124 |
| 2015/0329097 | A1 * | 11/2015 | Duran Ariza | B61B 3/02 104/23.1 |
| 2016/0355194 | A1 * | 12/2016 | Suppes | B64C 39/022 |
| 2017/0203919 | A1 * | 7/2017 | Schurba | B65G 1/0457 |
| 2019/0256110 | A1 * | 8/2019 | Suarez Ajo | B61B 1/02 |

FOREIGN PATENT DOCUMENTS

| | | | |
|---|---|---|---|
| ES | 296238 | A3 | 3/1964 |
| FR | 2248183 | A1 | 5/1975 |
| WO | 2005063544 | A1 | 7/2005 |

* cited by examiner

UNIVERSAL PUBLIC TRANSPORT AND UTILITIES DISTRIBUTION SYSTEM

The present invention relates to the transport and logistic infrastructure technological sector, and refers to a universal distributor (DUNI) of transport and public services that, through a cable-stayed bridge type metal structure, integrates a public transport system, a system of transportation and distribution of public services and a vehicular road.

STATE OF THE ART

As a direct consequence of the industrial revolution in the eighteenth century, the demographic explosion of humanity that continues to this day was generated. This created a flow of people to the cities attracted by the demand for labor, new technical advances and better living conditions than in the countryside. This is how large modern cities emerged and consolidated and, with these, a great demand for public infrastructure to organize and facilitate the daily performance of its inhabitants.

Today, several forms of public transport systems are known, including underground and elevated subway systems (more details at: http://www.plataformnaurbana.cl/archive/2015/09/11/los-11-mejores-sistemas-de-metro-del-mundo-segun-business-insider/) London subway system stands out as one of the oldest, inaugurated on 9 of January of 1863; New York subway system stands out as the most extensive underground subway in the world, having 1,062 km of tracks; Paris subway system has the largest number of stations with 298 stops and the one in Beijing, which has the highest frequency of passing trains, transports an estimated 3,400 million passengers per year.

Various elevated railway systems were also inaugurated since the last century. as a better solution for large cities, ranging from the Berlin elevated railway inaugurated in 1902, to the Dubai railway elevated subway inaugurated in 2009 (more details at: http://www.bogota.gov.co/content/ternas-de-ciudad/movilidad/las-razones-por-las-que-grandes-capitales-del-mundo-oplaron-por-metro-elevado). The elevated railway project in Riyadh, capital of Saudi Arabia is currently under construction, as well as the Bogota elevated railway system The suspended monorail systems stand out as the most ingenious solution for the daily mobilization of people in large cities, (more details at: http://www.structuralia.com/es/noticias-mx/25-ferrocarriles/10001675-monorrieles-en-el-mundo). In the German city of Wuppertal, you can find the world's oldest suspended monorail public transport, built in 1901 and which is fully operational, covering a route of 13.3 km with 20 stops. A suspended monorail urban public system began to operate In the Japanese city of Chiba, in 1988, that has two tracks, 18 stations and runs along a route of 15.2 km, which classifies it as the world's longest suspended monorail urban system and that continues to grow. In the same way there are projects of this kind of the public transport system in different countries, such as Ecuador, Peru and Mexico.

Bogota, capital of Colombia, is a city where traffic jams are a daily occurrence, so its inhabitants experience great difficulties to travel to their destinations for much of the day, especially in the so-called rush hours, which total more than 6 hours a day. This generates great problems concerning vehicle and passenger congestions, mainly due to the increase in the number of cars and private motorcycles in recent years, which shows a clear tendency of the population to avoid the daily use of public transport, to a large extent due to its inadequacies and low quality in several aspects. This situation has resulted in the application of unpopular measures such as the so-called peak and plate during peak traffic times, which prohibits the circulation of vehicles, that is, every day and at all hours. It also begins to affect other cities, not as populous as Bogota, as is the case of the city of Cali, where the increase in traffic in critical areas and the bad conditions of the transport infrastructure, has caused the implementation of the peak and plate system for motorcycles which encourages a greater use of bicycles as a means of transportation.

On Aug. 4, 2016, in the Colombian newspaper El Pais, comments were made by Mr. Luis Fernando Andrade, president of the National Infrastructure Agency, within the framework of the First International Congress of Business and Accounting Business Law, held in Cartagena, where he pointed out that Colombia is rapidly moving ahead to become more competitive and to be able to move out of the decades of backwardness in transport infrastructure which is the reason 70 billion pesos are being invested in projects throughout the country.

Hence, all these problems and technological advancements are reflected in different systems patented to date on this sector of public transport infrastructure and freight. Taking into consideration those that by their degree of similarity mark a precedent of the present invention, they are cited:

U.S. Pat. No. 3,511,186 filed on May 15, 1968 and published on May 12, 1970 of the inventor Maurice Barthalon, which discloses a conveyor comprising a continuous beam that serves as a track, with at least one automobile suspended and moving along said track and provided with drive means for imparting movement thereto and a sub atmospheric air pressure support system comprising at least one support chamber having a non-vertical supporting wall for said track, shutter means carried by said car and air extraction means connected to said support chamber. This proposal is about a suspended monorail system with some kind of pneumatic locomotion mechanism, which besides offering limited transportation capacity, does not integrate other transport systems.

U.S. Pat. No. 6,182,576 filed on Dec. 7, 1998 and published on Feb. 6, 2001, of the inventor Einar Svensson, discloses a monorail system for transporting passengers and light cargo, which provides a support structure with a essentially planar upper surface and a stabilizer guide rail having a vertical web portion supporting a head portion. This system works equally well with a variety of vehicle propulsion and suspension systems, including electromechanical, magnetic levitation or linear electric motors. However, the patent does not disclose the integration of other transportation systems, as is the case with the majority of monorail systems and elevated railway systems.

U.S. Pat. No. 6,363,857 filed on Jun. 7, 2000 and published on Apr. 2, 2002 of the inventor John Kauffman, discloses a transportation system that enables passengers to travel at high speeds relative to automotive traffic, while permitting each passenger to individually select his or her destination, commence travel whenever a transport is available, and travel with or without his own car. This system includes a system of guideways connecting various stations, so that a passenger can travel from an origination station, across guideways, to a destination station of choice. and wherein each guideway consists of parallel tracks supporting support magnets. The transporters have horizontally extending supports with transporter support magnets and can be designed in a variety of ways and equipped with numerous amenities. This solution is based on a rather personalized transport system, with a limited work capacity to assimilate the large volumes of transportation required in high traffic schedules, and besides, it is not integrated with other transport systems.

DESCRIPTION OF THE INVENTION

The universal distributor (DUNI) of the present invention comprises a cable-stayed bridge-type metal structure, where its main platform, physically and functionally integrates the three levels of which it is composed. FIG. 1 shows the three levels comprising: a monorail system of suspended wagons for public transport and cargo; a transportation and distribution system of public services and a roadway. The novelty of the present invention lies In the physical and functional integration of these three systems in a single structure.

The main platform that makes up the universal distributor, is located at a minimum height of 12 m above ground level and is supported by pillars (4) on both sides. The dimensions of the pillars correspond with the total weight of the distributor at the most critical operating moments. This platform has a modularity of 60 meters to longitudinally bridge up to a distance of maximum 60 m among pillars and is supported by four cables working as suspension cables (5), two on each side of the platform. The pillars are placed on both sides, both across and along the roadway on which it is decided to build the structure or other new paths, requiring very small areas of land for assembly and operation.

The design of this distributor is very flexible due to its great capacity to adapt to the dimensions and requirements of the existing roads on which it is decided to build the structure, because these can vary from four lanes, to large multi-lane highways in each direction, as seen in FIG. 3, or to the topography of the selected terrain in case of new layouts. This is due to its modular structure based on pillars that can be conveniently located both along the width and along the road on which the structure is to be built.

The three levels of the distributor are separately described below:

The first level, which starts from 6 meters above the ground surface, has a suspended monorail system for public transport. The wagons are electrically self-propelled, and they hang from a rail, which simultaneously constitutes one of the longitudinal beams (6) of the structure of the main platform, and having on each side of its lower end, a rail on which the beveled wheels of the electric traction system of the wagons move.

The electric traction system is fed through outlet strips laterally fixed to the beams of the monorail where a set of movable brushes moves. This system is made up of the metallic structure supporting the monorail wagons (7) and of the semi-rotating electric traction modules. The support structure has a mechanical device (8) coupled to the cylinder heads of the traction modules, to guarantee the stability of both modules during acceleration, running and braking. It also allows the correct assimilation of the turns required by the wagons at the ends of each closed circuit of the route, where the moments of maximum curvature of the monorail (9). are found.

The passenger carriages are 3 m wide, 2.7 m high and 16 m long, with an approximate load capacity of up to 200 passengers traveling at a maximum speed of 80 km per hour. Cargo cars generally have the same upper structure as passenger cars, except that in this case there are four electromechanical lifting groups conveniently located to operate containers of 20 and 40 feet. They also have a cabin for two operators, and the rest of its structure comprise a cage designed with the dimensions and locking and fixing mechanisms to house and fix the containers previously described.

All the wagons of the distributor have emergency safety and evacuation systems, in such a way that the height above the ground at which the wagons travel is never a problem for the safety of the passengers. Its operation is automatic and constantly monitored by an operator from a cabin as well as from a virtual office in the operations center. This operator can take manual control of all functions during certain emergencies.

The wagons can also travel in convoys, i.e in sets of two or three wagons maximum, always starting from the resting position. In such cases the wagons are wireless connected, so that the front wagon can operate in "master" mode, and those that follow can operate in "slave" mode, this means that all the actions taken by the first wagon will be replicated and adapted in real time by those who follow, guaranteeing an average distance between them that matches the locations of the doors at the stations.

The ordinary wagons have two doors on each side, as shown in FIG. 15, in such way that when they arrive at an express-type station, passengers can directly access it through the two doors on their left side. In the same way, it is possible to access from one station to the other through the same wagon, if the circumstances so permit. If it is not possible to pass through the wagon due to the number of passengers on board at those times, then a passage over the road is available, which is designed for passengers to pass through it.

The passenger stations of the system, are divided into three types according to their function:

1. Ordinary: they are located on the outer edge of the structure on the sidewalks or side of the track, and serve the wagons that stop at all stations. All the access of people to the public transport system from the ground is always done through these stations, through a small area designed to occupy the smallest possible surface, maintaining a high capacity of access and circulation of passengers in an orderly and controlled way.
2. Express: these stations are located in parallel, on the inside of the ordinary stations. They serve simultaneously, that is, on both sides, to the ordinary wagons that stop at all stations on their right side, and to the express wagons that only stop at certain predetermined sections, on their left side, always oriented in the direction of the wagons, thus allowing the direct transfer of the passengers between both types of lines.
3. Trunk: these stations are located at the intersections of two structures that are always on different levels, that is, one structure passes over the other. It consists of two conveniently superimposed express type stations, which allow passengers to change structure or line without leaving the system when their final destinations so require.

These three types of stations have an upper passage that joins the stations located on both sides of the track, which allows passengers to select the required wagons without leaving the system, and allows pedestrians to safely cross over the track. The express and trunk stations, due to their size and influx of passengers, and thanks to their elevated design, conveniently have services annexed to the distributor, such as food courts, related shops, associated parking lots, service pumps, heliports and others.

All this allows a greater integration of the services required by citizens. In the case of the associated parking lots, in addition to be a value-added service for the distributor, it favors and encourages an authentic and healthy integration between the use of private cars and public transport. In the same way one of its roads could be assigned as a cycle route with all the security guarantees for its users.

This suspended monorail system for public transport, offers a high efficiency in the consumption of electricity, as it is integrated into the electrical transmission and distribution system, which additionally guarantees a very low ecological impact, by generating zero carbon dioxide emissions for its operation. In addition, it offers a high and effective work capacity, based on its possibilities of increasing or decreasing the passage frequency of the wagons depending on the demand. Having a frequency of up to three wagons per minute in each line per station during peak hours. In this way, access problems regarding mobility that could exist before the start of the operation of the system are solved.

Likewise, this distributor consists of a center of management, administration, supervision and control offices, which are located at its ends. In these centers there is an entire attached structure from where, through a sliding platform (10), the entry and exit of the wagons to the public transport system is controlled and managed according to peak demand schedules. It is also in this structure where all the wagons will be temporarily parked and all the cleaning, maintenance and repairs will be carried out.

The sliding platform, through which the operation of entry and exit of the wagons to the system will be performed, has a maximum operating capacity of up to 6 wagons simultaneously in an approximate time loop of 2 minutes to complete the operation. Optionally, in these centers there will be a virtual room that will have all the technological support required so that each wagon can be virtually supervised and managed by remote control, if so required.

The second level has a system of technological conduits attached to the structure of the platform which simultaneously allow the transportation, distribution and provision of general public services and other optional services first hand, as well as to reorganize and enhance the totally underground distribution through its pillars.

This system runs through the same structure as the main platform. Its design divides in two halves the frontal surface of the transverse beams of the structure, in such a way that the installation of the ducts is made through the upper half of the front surface of the beams, reserving the lower half to allow entry or the exit of all the required conduits, either for admission or service derivations.

In this way it is achieved that all the distribution of services in the areas surrounding the distributor is by underground tracks, avoiding the use of poles for both electrical and telecommunication distributions. In the same sense, the existence of poles for public lighting is not required, because this function is also assumed by the same structure of the distributor (11). These technological conduits are built according to the standards and technical requirements of each public service to be transported and distributed. Below is a brief description of each public service separately 1. Electrical system: it can distribute high, medium and low voltage, which simultaneously allows obtaining first hand and with the highest possible efficiency the most suitable voltage to power the electrical propulsion system of the wagons of the public service. It also provides all the industrial, commercial and residential electrical distribution to the areas surrounding the distributor, trough its own transformer network, and interconnecting other networks within the city.

2. Telecommunications system: it has a network of fiber optic cables, including all technological cabinets designed to assume with total reliability and reserves, the highest quality and performance requirements required for communications, both for the correct operation of the automated public transport system, and to provide a stable and solid Wi-Fi network to the entire distributor and to the surrounding residential areas. By means of the pillars it is possible to enhance the network of cellular antennas, due to its height, which is always greater than 20 meters. All this system can be constituted in a high quality platform that can be managed and negotiated as a support for all the operators in the city, interested in a better service.

3. Aqueduct system: it has a network of conductors and distributors, with its automated system of protections, pumps and valves required for its correct operation. In this way the supply and distribution of water in the distributor and surrounding areas in its path is guaranteed. In the same way, existing networks in the city can be interconnected and their performance and quality of service can be improved. Simultaneously, it supplies and feeds the distributor's fire system according to all the required technical standards.

4. Natural gas system: it has an automated network of specialized pipes and valves for the safe transportation of residential and vehicular natural gas, and all the derivations required for industrial, commercial and residential distribution.

5. Optional: a network for the transportation and distribution of fuels can be designed and operated under the safety and protection standards required to guarantee the supply to the existing service pumps on the distributor structure, and thus supply all those remaining in the surrounding areas.

In addition to these general public service systems, the duct system can be used for specific uses, always complying with the required safety and environmental protection standards.

Level three has a road for light cars, ambulances, freight distribution cars and others, whose gross weight do not exceed 3 tons and their height above the floor do not reach 3 meters. It is a synthetic road built for high performance in terms of spaciousness and road safety. All accesses have an electronic toll system that guarantees compliance with the fundamental parameters required for vehicles to enter the system, and additionally the commercial technical requirements determined by the administration of the distributor.

Due to the fact that this roadway does not have intercepts at the level with each other, its general design is oriented so that the vehicular circulation is very fluid and agile, so that by its interior lanes, that is to the side of the separator, the circulation can be at high speeds, at approximately 100 km per hour, without entailing the risks of accidents. And the rest of the lanes are designed so that the vehicles do not have to stop at some point during their entry, circulation and exit from the distributor, e, except for reasons of force majeure, such as traffic accidents, mechanical failures or natural phenomena.

The construction system of this distributor can be very compact and agile, since it is only necessary to build the first 180 m of the structure from the ground, because from that moment a kind of mother crane can be installed on the same structure, which will continue the assembly of the rest of the structure along the entire route, advancing on what has been built, and it will only be necessary to carry out on the ground, the excavations of the foundations for the assembly of the pillars, as well as some specific support required by the assembly operations to support the mother crane.

In a general sense, the present invention offers a very compact and functional physical integration concept between public and vehicular transportation, by placing them on the same platform, in addition to including, and with dual purpose, the transportation and distribution of almost all general public services, which makes a great difference with respect to the main transport systems and their infrastructures known to date. Thus, it constitutes an integral solution for the major problems of urban public transport, transportation and distribution of public services and for vehicular mobility in large cities. In the same way it opens the possibility of being applied to make new open field layouts, or to connect existing roads to each other.

DESCRIPTION OF THE FIGURES

FIG. 1 shows the front view of the distributor, where a first level (1) is observed, from which a monorail system of suspended wagons for public and freight transport is arranged, which starts from a height of 6 m above ground level. At a second level (2), located 12 meters high, the lower part of the main platform begins, through which a system of technological conduits runs for the transportation and distribution of public services and other optional services. On the third level (3), and on the upper surface of the main structure, there is a vehicular road.

The wagons are electrically self-propelled and hang from a monorail, which simultaneously constitutes one of the longitudinal beams (6) of the structure of the main platform, and which along its lower end has a rail on both sides, where the beveled metal wheels of the electric traction system of the wagons move. The luminaires of the public lighting system (11), are supported by the same structure of the distributor.

Figure 1:
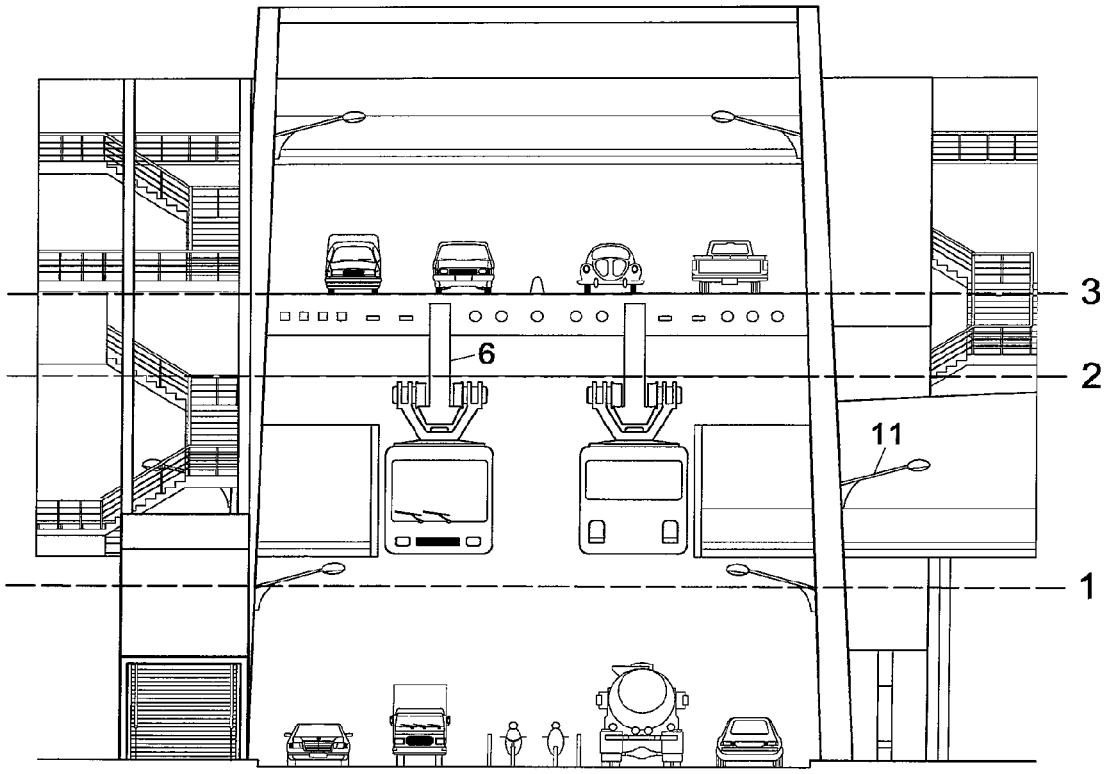
FIG. 1. Basic frontal elevation diagram of the universal distributor (DUNI) of transports and services.
Figure 2:
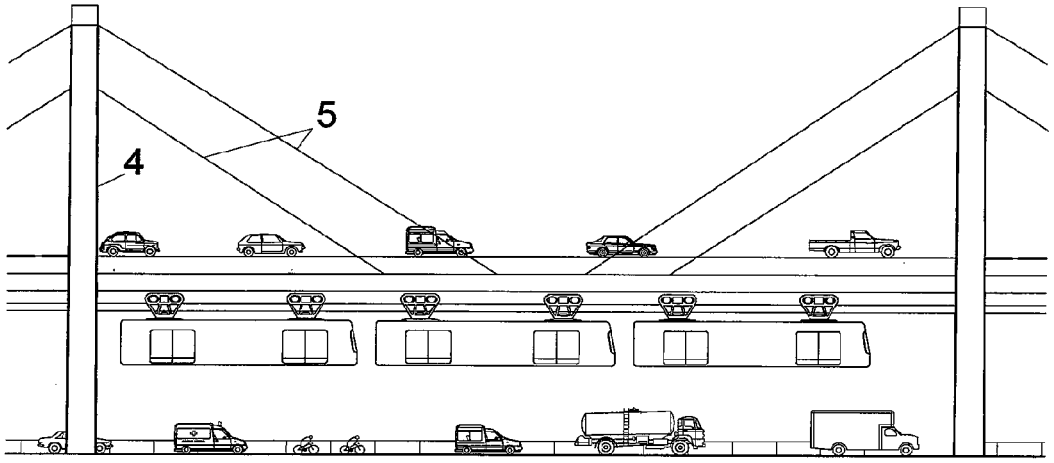
FIG. 2. Lateral elevation diagram of the transports and services universal distributor (DUNI).

FIG. 2 shows a side view of the distributor, in which its general structure is observed, composed of the main platform supported by the pillars (4), modularly spaced at 60 m, aided by the tie rods (5).

Figure 3:
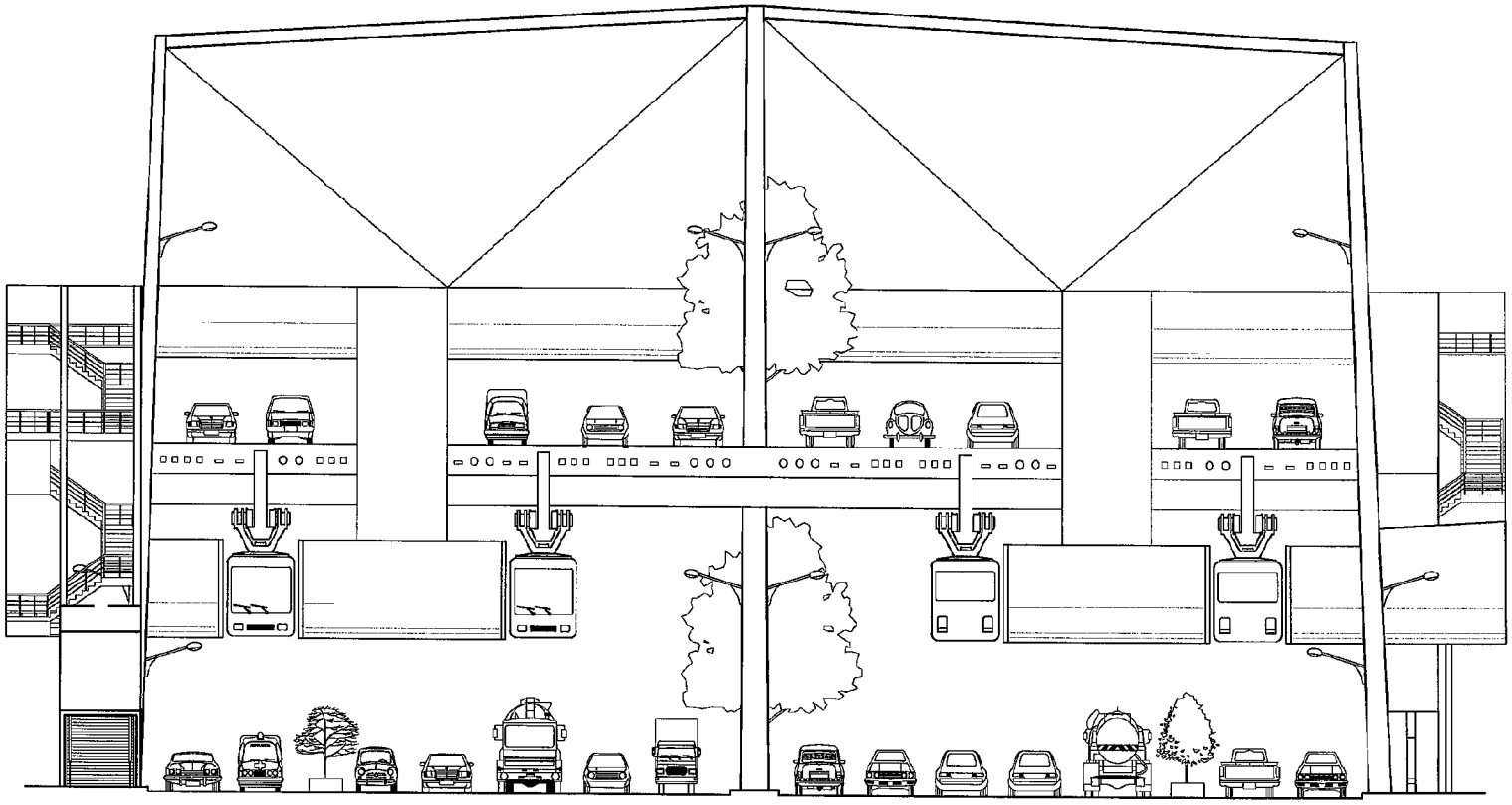
FIG. 3. Front elevation diagram of ordinary-express lines.

FIG. 3 shows the design flexibility of the distributor to adapt to the requirements of the roads on which it is decided to build it. In this case it is a frontal view of an ordinary-express line, due to the width of the highway on which the concept of the system is shown.

Figure 4:
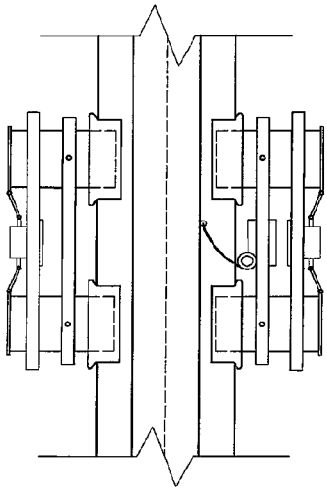
FIG. 4. Plan diagram of the traction system on straight monorail.

FIG. 4 shows the traction system on the monorail at a straight moment, and the electrical power system through outlet strips where the set of movable brushes moves.

Figure 5:
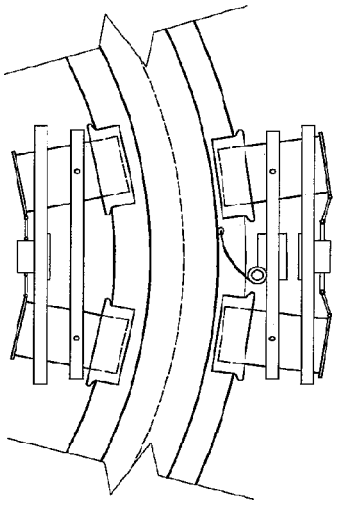
FIG. 5. Plan diagram of the traction system on curved monorail.

FIG. 5 shows the traction system on the monorail at its moment of maximum curvature.

Figure 6:
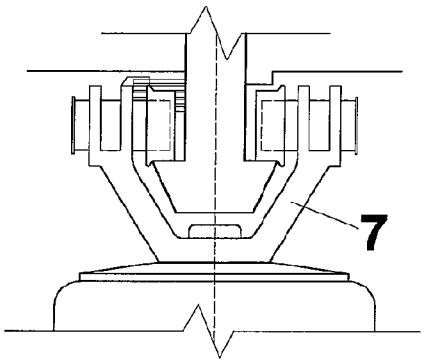
FIG. 6. Front elevation diagram of the mechanical support structure of the wagons to the monorails.

FIG. 6 shows the front view of the metallic support structure (7) of the wagons to the monorail, which includes the traction modules.

Figure 7:
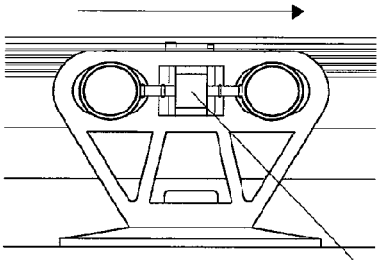
FIG. 7. Side elevation diagram of the mechanical support structure of the wagons to the monorails.

FIG. 7 shows the side view of the support structure, where its coupling to the semi-rotating electric traction modules can be observed. The location of the mechanical device (8) is also indicated, which is coupled to the heads of the traction modules to ensure the stability of both modules during acceleration, running and braking.

Figure 8:
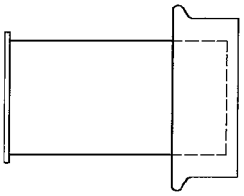
FIG. 8. Side view diagram of the traction module.

FIG. 8 shows the traction module, which contains the electric motor mechanically integrated within its cylindrical structure, with its transmission mechanism and brake system, coupled to the metal wheel which is beveled by its internal edge.

Figure 9:
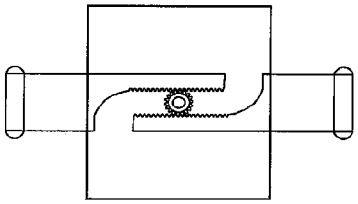
FIG. 9. Detail of a side view of the mechanical device for controlling the heads of the traction modules.
Figure 16:
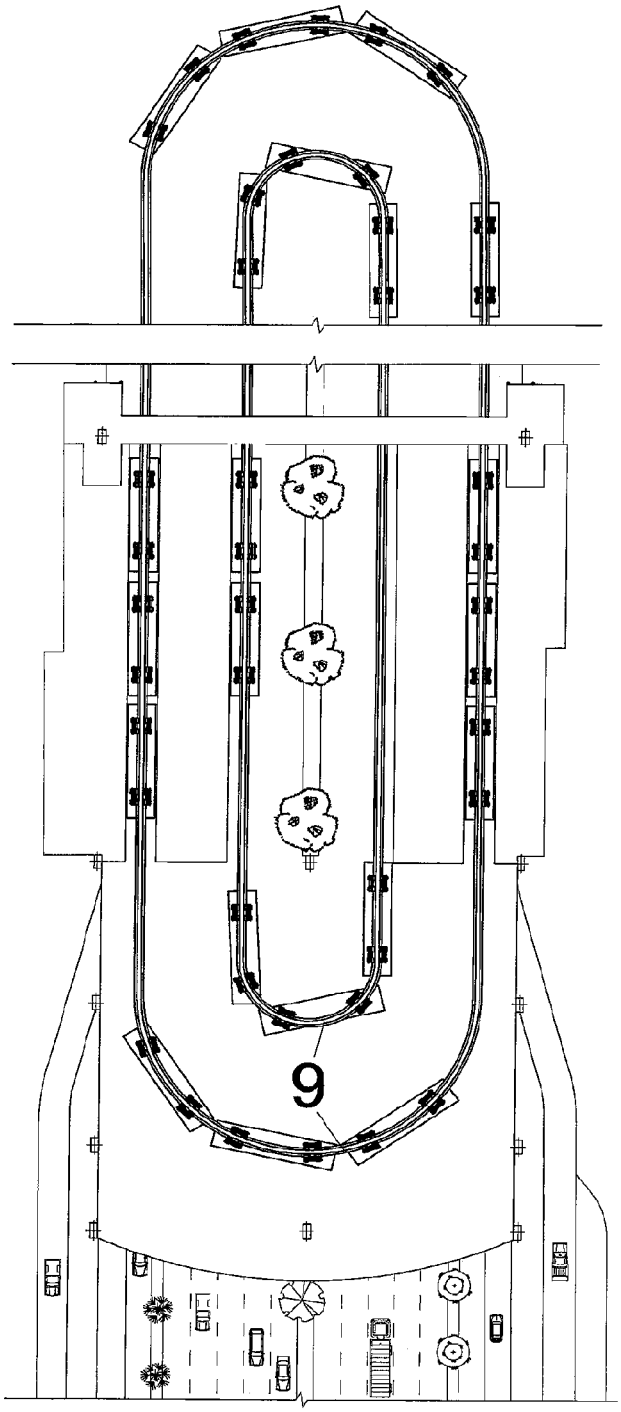
FIG. 16. Plan diagram of the monorail routes.

FIG. 9 details the interior of the mechanical device for controlling the cylinder heads of the traction modules. This mechanical device allows the correct assimilation of the turns required by the wagons at the ends of each closed circuit of the route, where the moments of maximum curvature of the monorail (9) are found, as can be seen in FIG. 16.

Figure 10:
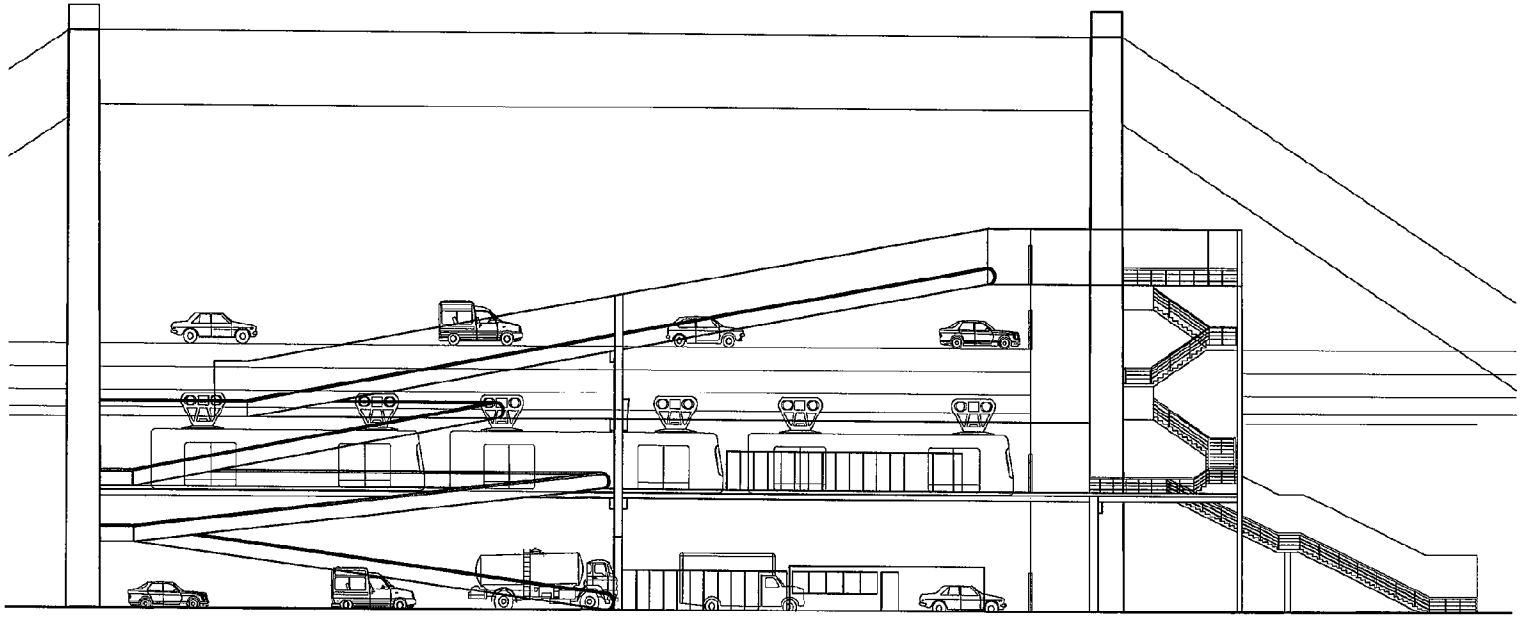
FIG. 10. Side elevation diagram of an ordinary type station.
Figure 11:
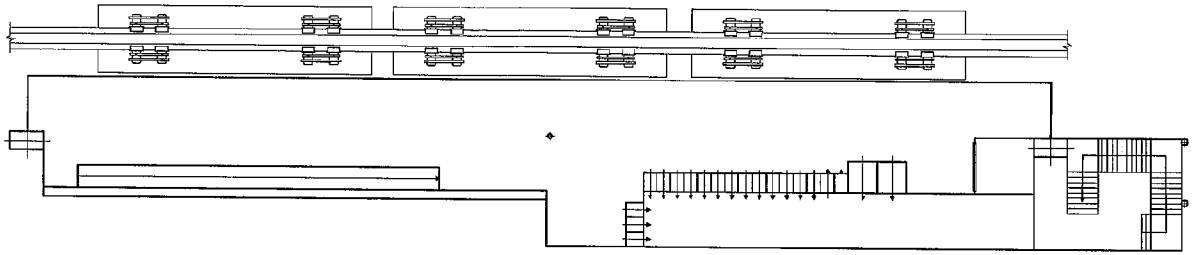
FIG. 11. Detail of an ordinary type station plan.

FIG. 10 shows the side view of the ordinary type stations and FIG. 11 the plan view of these ordinary type stations.

Figure 12:
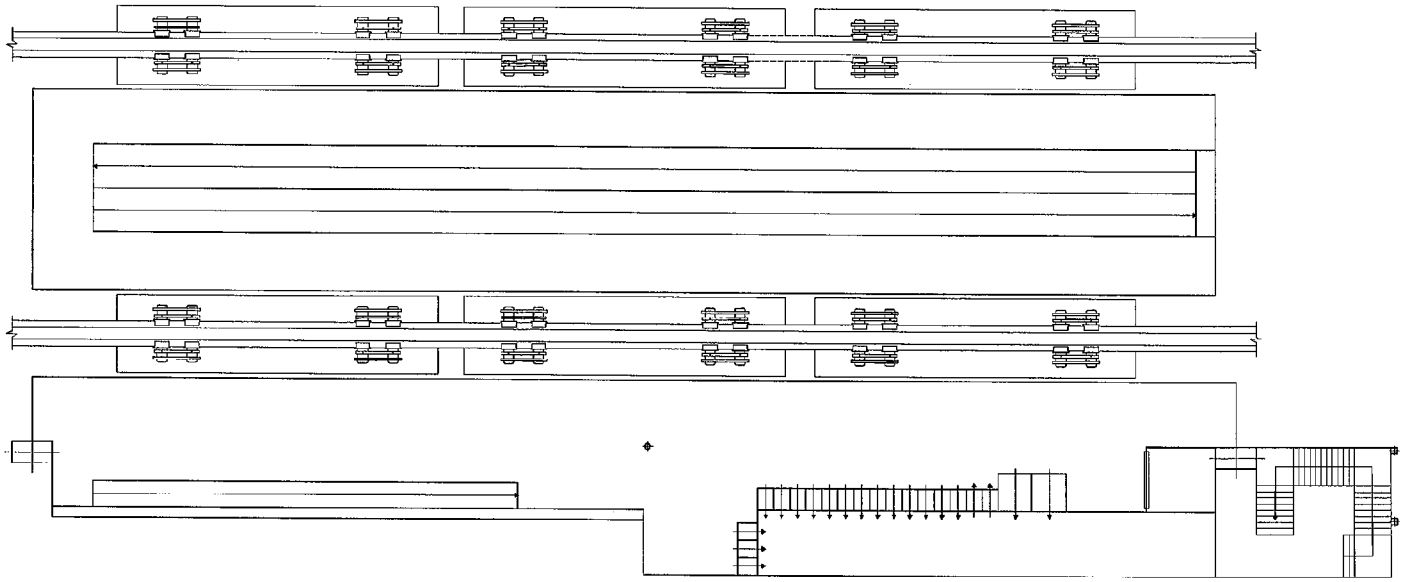
FIG. 12. Detail of an express type station plan.

FIG. 12 shows the plan view of the express type stations. Its lateral view is covered by the same side view of the ordinary stations, for this reason only its plan view appears.

Figure 13:
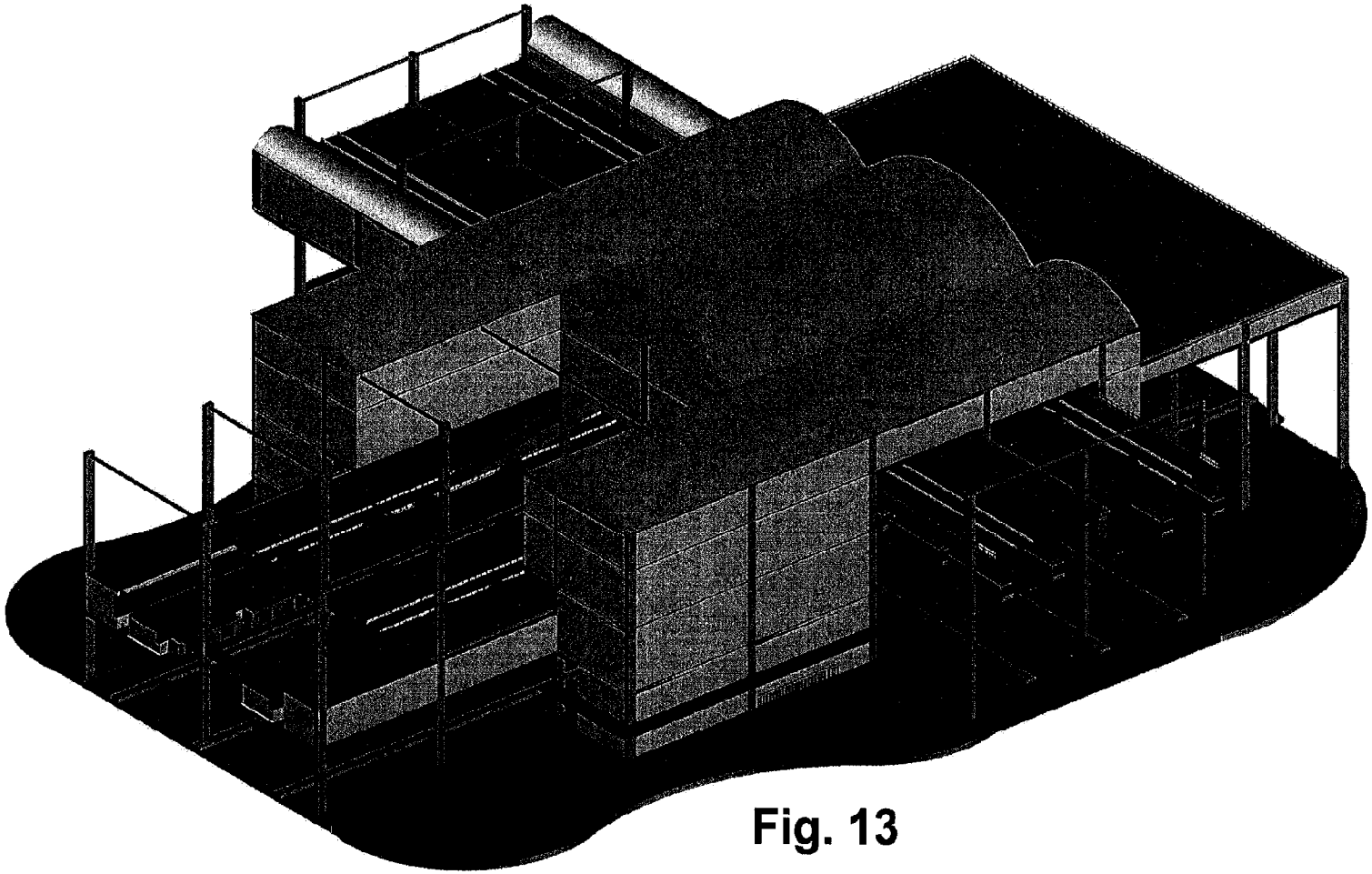
FIG. 13. Trunk type station diagram.

FIG. 13 shows the full span of the trunk type stations, located on the intersection of two structures that are not at the same level.

Figure 14:
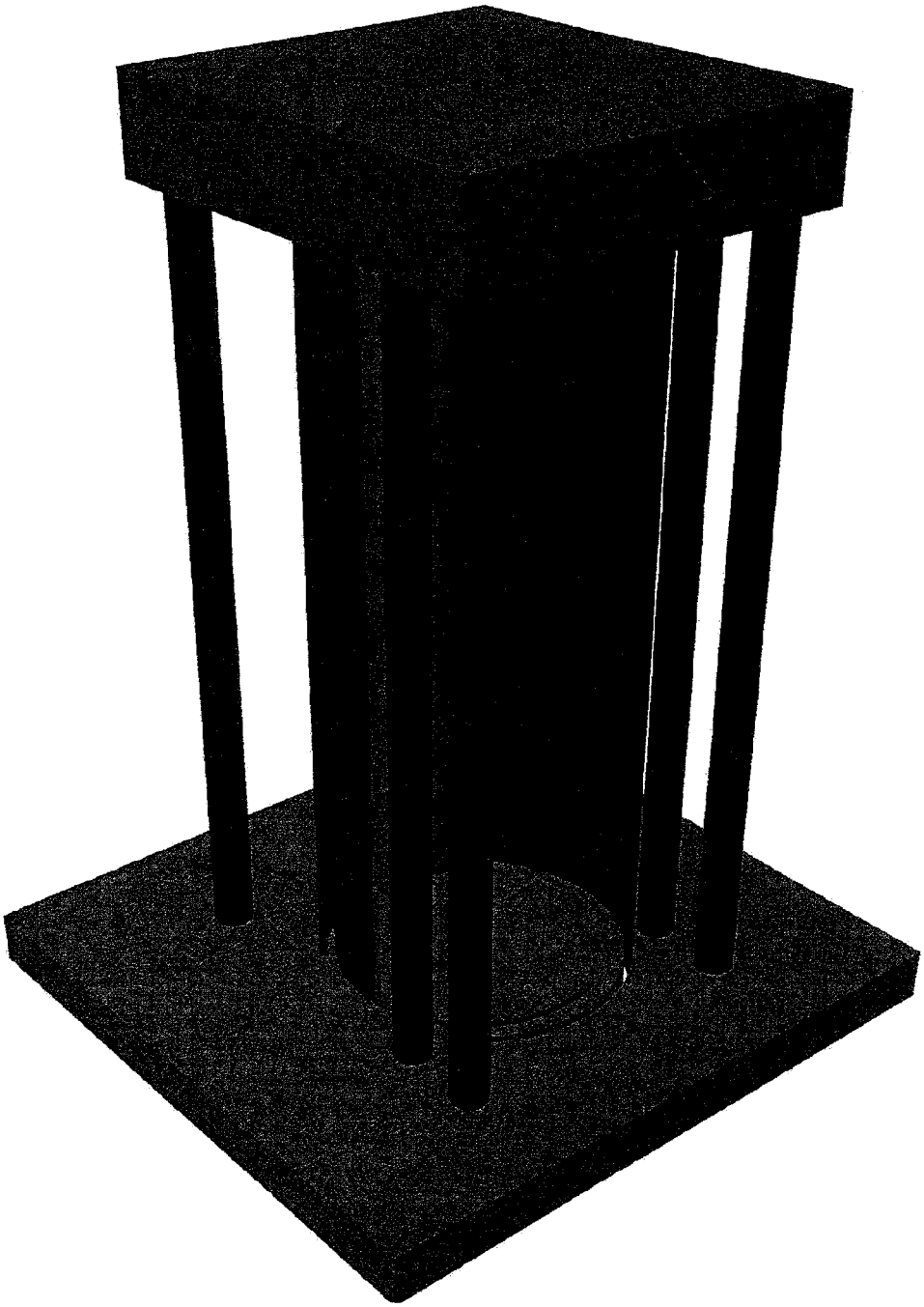
FIG. 14. Diagram of the passenger access door to the stations.

FIG. 14 shows the design of the passenger access doors to the stations, which guarantees the entry and exit process in an orderly, controlled and agile manner, in addition to ensuring, to a large extent, the payment of the ticket by the passengers of the system.

Figure 15:
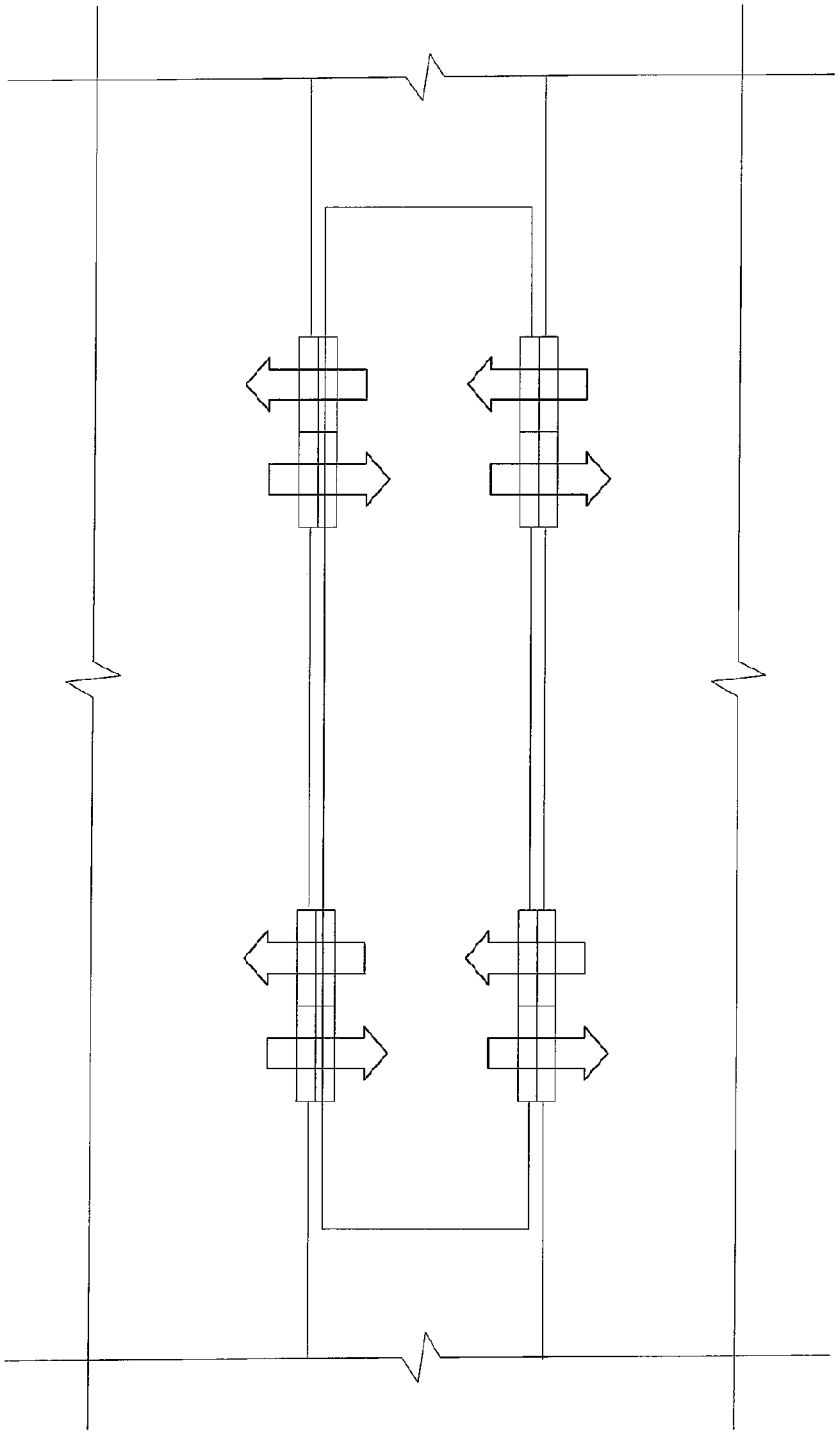
FIG. 15. Plan detail of the common wagons with their double side accesses.

FIG. 15 exemplifies the functional design of ordinary passenger carriages, which have two 3 m wide doors on each side with two symmetrical sheets each and a system for opening and closing by floor and wall sliders.

FIG. 16 shows the plan view of the layout of the monorail lines, which are designed so that the wagons are moved in one direction and in closed circuits without interceptions between the two lines or derivations.

Figure 17:
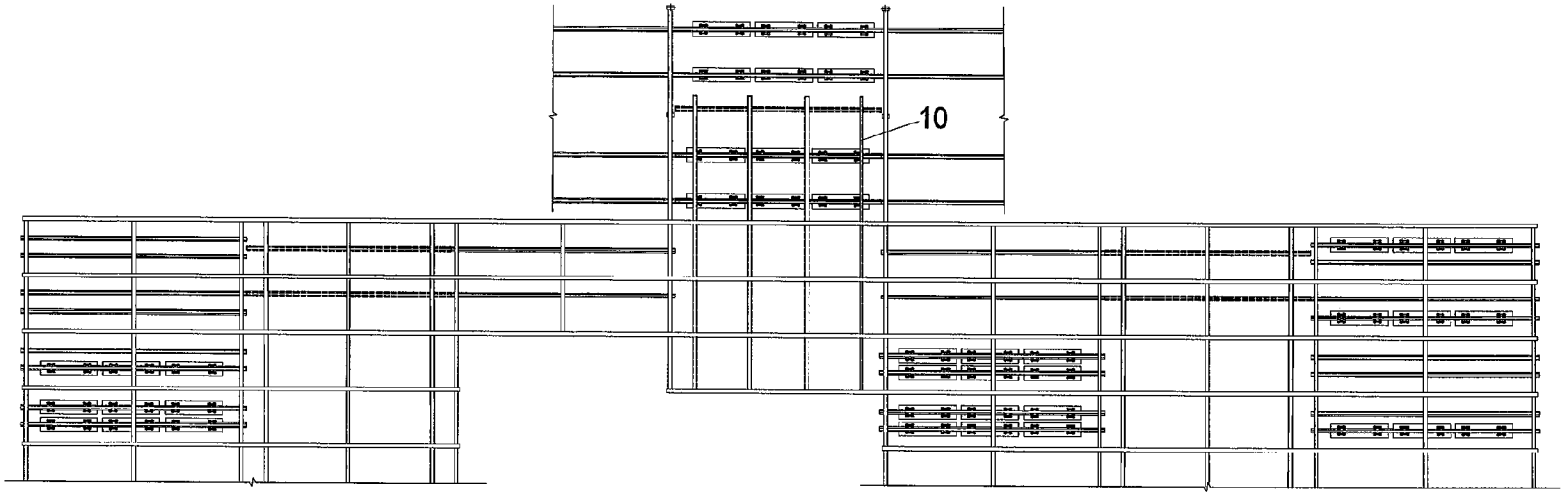
FIG. 17. Plan diagram of the distributor's management, administration and control of the distributor center.

FIG. 17 shows the plan view of the structures in the area where the central offices of management, control and supervision of the entire operation of the public transport system and the distributor in general are located. As part of this structure, the sliding platform (10) is shown by which the maneuvers of entry and exit of the wagons to the public transport system are carried out.

Figure 18:
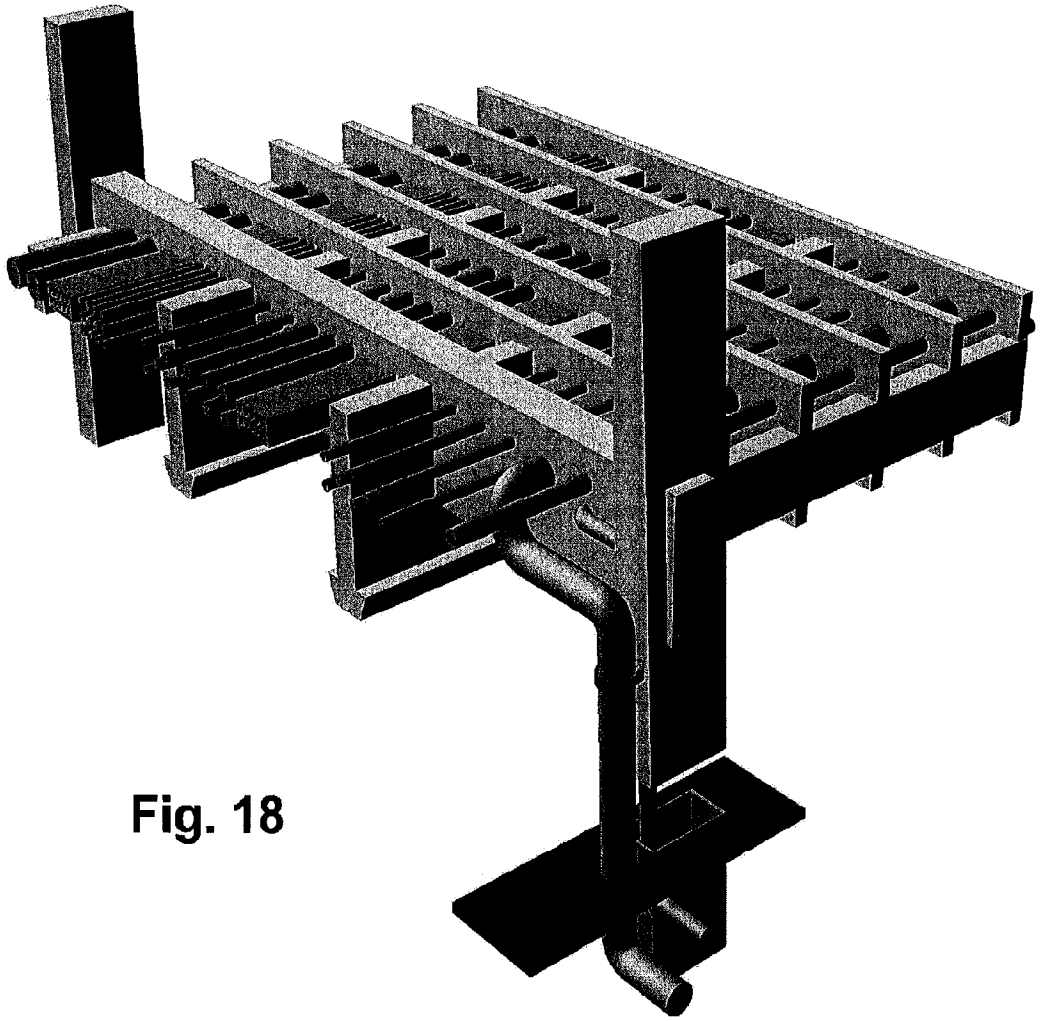
FIG. 18. Detail of the transportation and distribution system of public services.

FIG. 18 shows the concept of the technological duct system, running through the structure of the main platform, and its capacity to perform the derivations required by the different services through the pillars to the underground distribution system.

Figure 19:
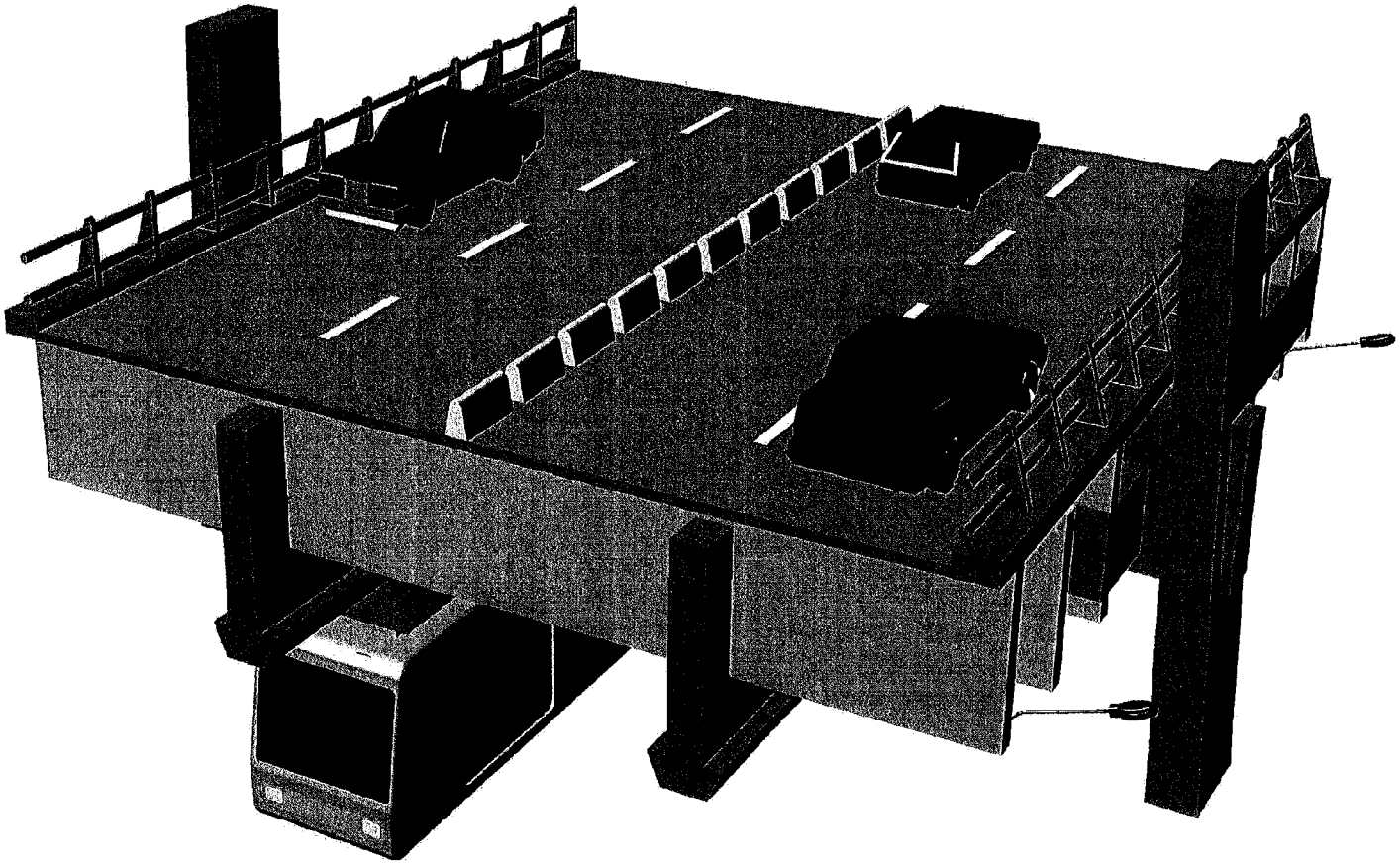
FIG. 19. Diagram of the vehicular road.

FIG. 19 shows the basic vehicular road running along the entire length and width of the upper surface of the main platform.

Figure 20:
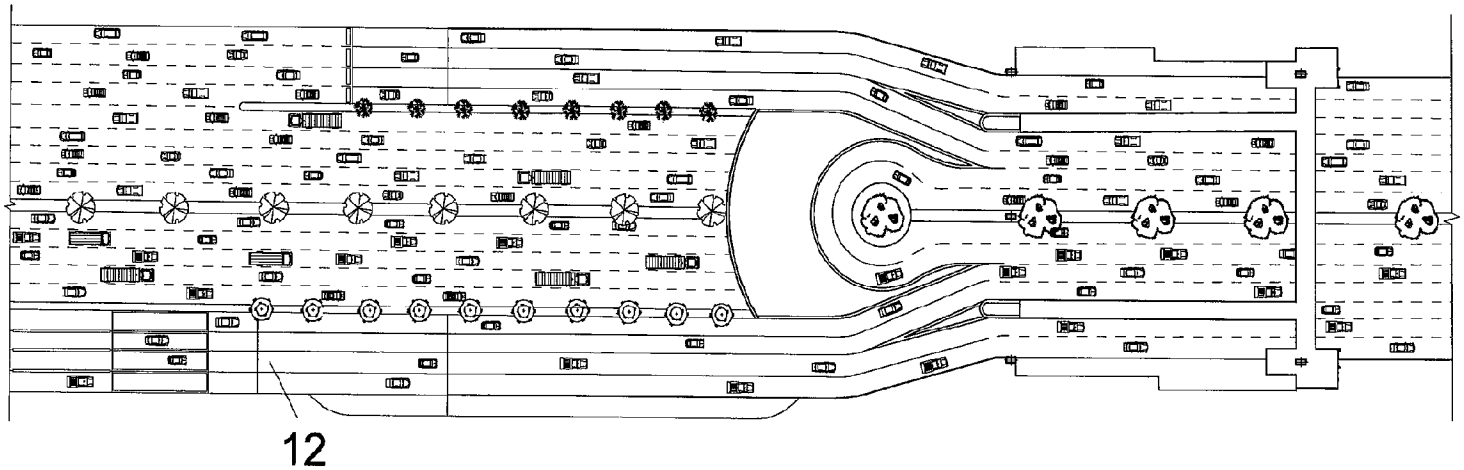
FIG. 20. Plan diagram of the main access to the vehicular road.

FIG. 20 shows a plan view of the main access to the road, which is located at the ends of the structure, which is generally located on the outskirts of cities. This access has a toll system to control the correct entry of vehicles into the system (12).

Figure 21:
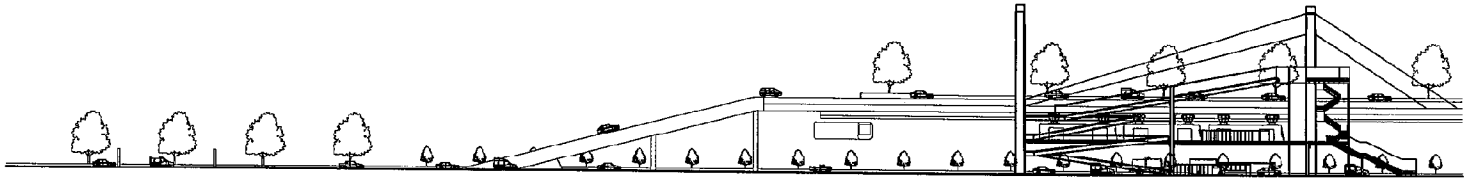
FIG. 21. Side elevation diagram of the main access to the vehicular road.

FIG. 21 shows a side view of the main access to the road, located on the outskirts of the city.

Figure 22:
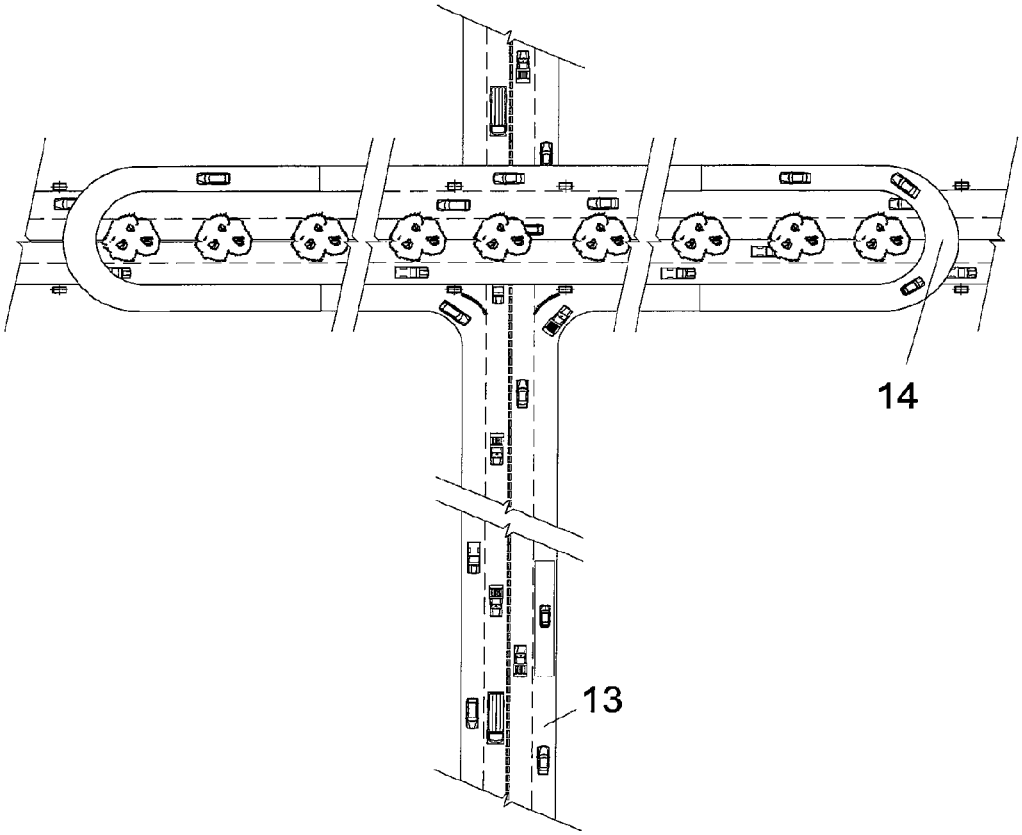
FIG. 22. Plan detail of the secondary accesses to the vehicular road.

FIG. 22 shows a plan view of a secondary access point to the roadway along the structure. It is also possible to observe the location of the grade-separated road returns (14), which allow the interconnection between grade-separated structures and changes of direction of the vehicles, without having to stop. These accesses also have a toll system to control the entry of vehicles into the system (13).

Figure 23:
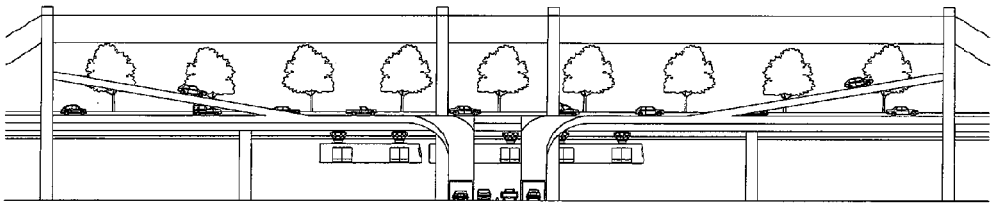
FIG. 23. Lateral elevation diagram of the secondary accesses to the vehicular road.

FIG. 23 shows the side view of the secondary access point to the roadway.

Figure 24:
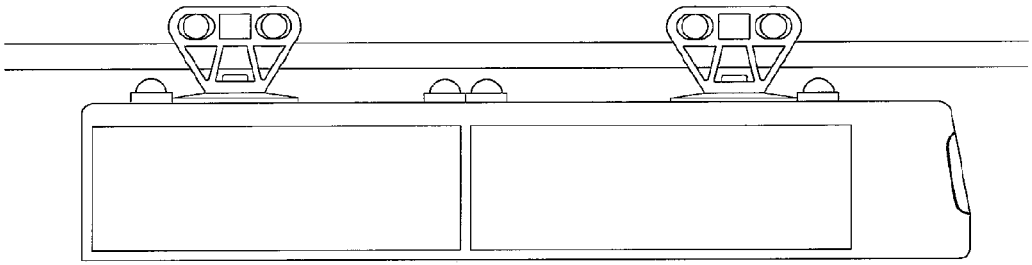
FIG. 24. Elevation diagram of the freight wagons with their lifting systems.

FIG. 24 shows a side view of the freight wagon.

Figure 25:
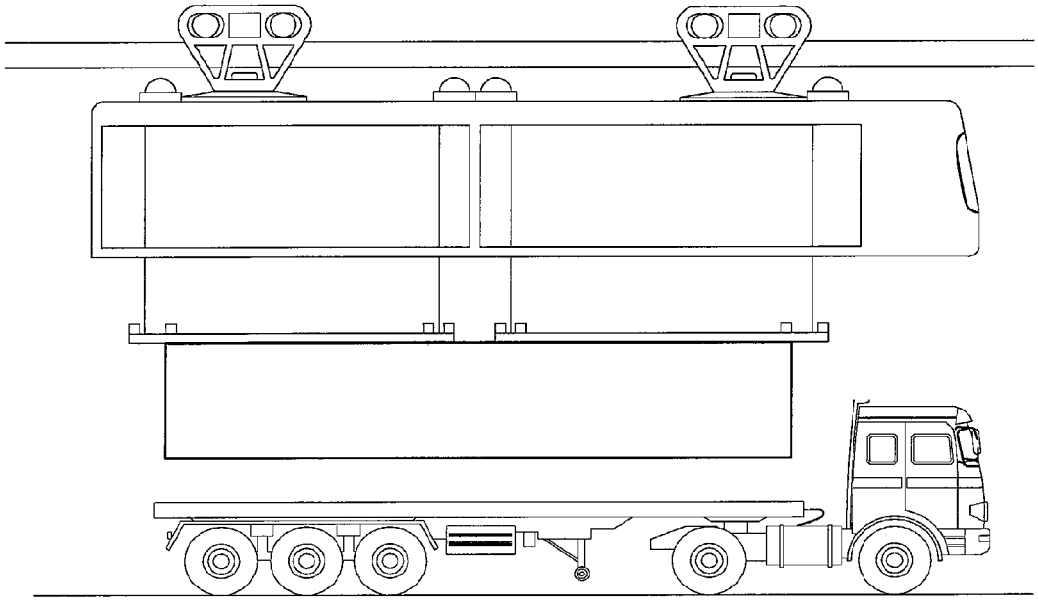
FIG. 25. Elevation diagram of the wagons loading and unloading process.

FIG. 25 shows a side view of the operation of the lifting system of a freight car, based on a brief and simple lifting operation, either from the ground or directly from the surface of a truck bed, both for loading and unloading processes.

The invention claimed is:

1. Universal distributor of public transport and services comprising a cable-stayed bridge-type structure supported by a plurality of pillars (4) and tie-rods (5), said structure includes a plurality of longitudinal beams extending along the length of the distributor, wherein said distributor defines a bottom road, an upper road and a suspended wagon monorail system for public transport; wherein said bottom road, upper road and monorail system are located in three vertically superimposed levels, and wherein top portion of said longitudinal beams supports said upper road and said monorail system is suspended from bottom portion of said longitudinal beams.

2. Universal distributor of public transport and services, according to claim 1, wherein the monorail system includes wheels of the suspended wagons.

3. Universal distributor of public transport and services, according to claim 1, wherein the monorail system includes self-propelled electric modules of the suspended wagons (7).

4. Universal distributor of public transport and services, according to claim 1, wherein the monorail system includes a mechanical device for controlling and reversing cylinder heads of the electric modules of the suspended wagons.

5. Universal distributor of public transport and services, according to claim 1, having administration and general control centers of the public transport system, characterized by its sliding platform (10) that allows the wagons to enter and exit the public transport system in an agile and safe way.

6. Universal distributor of public transport and services, according to claim 1, wherein the upper road is a roadway for semi-light vehicles, and which defines an uninterrupted path for vehicles.

* * * * *